US008398197B2

(12) United States Patent
Houjou

(10) Patent No.: US 8,398,197 B2
(45) Date of Patent: Mar. 19, 2013

(54) INKJET RECORDING APPARATUS AND INKJET RECORDING METHOD

(75) Inventor: Hiroaki Houjou, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 283 days.

(21) Appl. No.: 12/696,428

(22) Filed: Jan. 29, 2010

(65) Prior Publication Data

US 2010/0194805 A1 Aug. 5, 2010

(30) Foreign Application Priority Data

Jan. 30, 2009 (JP) ..... 2009-020321

(51) Int. Cl.
*B41J 29/38* (2006.01)

(52) U.S. Cl. ..... 347/14

(58) Field of Classification Search ..... 347/100, 347/14

See application file for complete search history.

(56) References Cited

U.S. PATENT DOCUMENTS

| | | | | |
|---|---|---|---|---|
| 2003/0016269 | A1* | 1/2003 | Sekiya | 347/42 |
| 2003/0142188 | A1* | 7/2003 | Jurrens et al. | 347/102 |
| 2007/0296790 | A1* | 12/2007 | Nakazawa et al. | 347/102 |
| 2008/0018690 | A1* | 1/2008 | Nishida | 347/18 |
| 2008/0143772 | A1* | 6/2008 | Konno et al. | 347/16 |

FOREIGN PATENT DOCUMENTS

| | | | |
|---|---|---|---|
| JP | 2006-82254 | A | 3/2006 |
| JP | 2008-62503 | A | 3/2008 |
| JP | 2008-100511 | A | 5/2008 |
| WO | WO-2008/035797 | A1 | 3/2008 |

* cited by examiner

*Primary Examiner* — Laura Martin
(74) *Attorney, Agent, or Firm* — Birch, Stewart, Kolasch & Birch, LLP

(57) ABSTRACT

An inkjet recording apparatus includes: a treatment liquid deposition device which deposits on a recording medium a treatment liquid having a function to aggregate inks or increase viscosity of inks; an ink deposition device which includes a plurality of ink heads for ejecting the inks of at least two types in such a manner that the inks are deposited on the recording medium on which the treatment liquid has been deposited; and a heating-pressuring device which fixes the inks that have been deposited on the recording medium, wherein the ink deposition device ejects the inks from the plurality of ink heads in such a manner that following Relationships (A) and (B) are satisfied where $M_x$ represents in-plane average deposition volume of one of the inks that is priorly deposited on the recording medium, $M_y$ represents in-plane average deposition volume of another one of the inks that is subsequently deposited on the recording medium, and N represents number of the types of the inks ($1 \leqq x < y \leqq N$), Relationship (A): $M_x + M_y < 10$ picoliters; and Relationship (B): $|M_x - M_y| = 3$ picoliters.

19 Claims, 5 Drawing Sheets

FIG.2

EXPERIMENTAL EXAMPLE 1

| | | IN-PLANE AVERAGE VOLUME M1 [pl] | | |
|---|---|---|---|---|
| | | 3 | 4.5 | 6 |
| IN-PLANE AVERAGE VOLUME M2 [pl] | 3 | Excellent | Excellent | Very Good |
| | 4.5 | Excellent | Excellent | Average |
| | 6 | Excellent | Average | Poor |
| | 9 | Average | Average | Poor |

EXPERIMENTAL EXAMPLE 2

| | | IN-PLANE AVERAGE VOLUME M1 [pl] | | |
|---|---|---|---|---|
| | | 3 | 4.5 | 6 |
| IN-PLANE AVERAGE VOLUME M2 [pl] | 3 | Excellent | Very Good | Good |
| | 4.5 | Excellent | Very Good | Poor |
| | 6 | Excellent | Poor | Very Poor |
| | 9 | Average | Poor | Very Poor |

EXPERIMENTAL EXAMPLE 3

| | | IN-PLANE AVERAGE VOLUME M1 [pl] | | |
|---|---|---|---|---|
| | | 3 | 4.5 | 6 |
| IN-PLANE AVERAGE VOLUME M2 [pl] | 3 | | Very Good | Good |
| | 4.5 | Excellent | Very Good | Poor |
| | 6 | Excellent | Poor | Very Poor |
| | 9 | Average | Poor | Very Poor |

EXPERIMENTAL EXAMPLE 4

| | | IN-PLANE AVERAGE VOLUME M1 [pl] | | |
|---|---|---|---|---|
| | | 3 | 4.5 | 6 |
| IN-PLANE AVERAGE VOLUME M2 [pl] | 3 | | Good | Good |
| | 4.5 | Excellent | Good | Very Poor |
| | 6 | Very Good | Poor | Very Poor |
| | 9 | Average | Poor | Very Poor |

FIG.3

EXPERIMENTAL EXAMPLE 5

| RATIO OF PRESENCE OF DROPLET SIZE OF FIRST COLOR [%] | | IN-PLANE AVERAGE VOLUME M1 [pl] | IN-PLANE AVERAGE VOLUME M2 [pl] | IMAGE OFFSET | |
|---|---|---|---|---|---|
| 3pl | 6pl | | | REMAINING AMOUNT OF WATER 4 g/m² | REMAINING AMOUNT OF WATER 4.5 g/m² |
| 100% | 0% | 3 | 6 | Excellent | Excellent |
| 80% | 20% | 3.6 | 6 | Very Good | Average |
| 60% | 40% | 4.2 | 6 | Average | Poor |
| 40% | 60% | 4.8 | 6 | Average | Poor |
| 20% | 80% | 5.4 | 6 | Poor | Very Poor |
| 0% | 100% | 6 | 6 | Poor | Very Poor |

FIG.4

EXPERIMENTAL EXAMPLE 6

| IN-PLANE AVERAGE VOLUME [pl] | | | M1+M2 | M1+M3 | M2+M3 | \|M1-M2\| | \|M1-M3\| | \|M2-M3\| | IMAGE OFFSET |
|---|---|---|---|---|---|---|---|---|---|
| M1 (MAGENTA) | M2 (CYAN) | M3 (YELLOW) | [pl] | [pl] | [pl] | [pl] | [pl] | [pl] | |
| 3 | 3 | 3 | 6 | 6 | 6 | 0 | 0 | 0 | Excellent |
| 3 | 3 | 4.5 | 6 | 6 | 7.5 | 0 | 1.5 | 1.5 | Excellent |
| 3 | 3 | 6 | 6 | 6 | 9 | 0 | 3 | 3 | Very Good |
| 3 | 3 | 9 | 6 | 6 | 12 | 0 | 6 | 6 | Average |
| 3 | 4.5 | 3 | 7.5 | 7.5 | 7.5 | 1.5 | 0 | 1.5 | Excellent |
| 3 | 4.5 | 4.5 | 7.5 | 7.5 | 9 | 1.5 | 1.5 | 0 | Very Good |
| 3 | 4.5 | 6 | 7.5 | 7.5 | 10.5 | 1.5 | 3 | 1.5 | Average |
| 3 | 6 | 3 | 9 | 9 | 9 | 3 | 0 | 3 | Very Good |
| 3 | 6 | 4.5 | 9 | 9 | 10.5 | 3 | 1.5 | 1.5 | Average |
| 6 | 3 | 3 | 9 | 9 | 6 | 1.5 | 3 | 1.5 | Very Good |
| 6 | 4.5 | 3 | 10.5 | 10.5 | 7.5 | 1.5 | 3 | 1.5 | Average |
| 6 | 6 | 3 | 12 | 12 | 9 | 0 | 3 | 3 | Average |
| 6 | 6 | 6 | 12 | 12 | 12 | 0 | 0 | 0 | Poor |
| 9 | 3 | 3 | 12 | 12 | 6 | 6 | 6 | 0 | Poor |

FIG.5

EXPERIMENTAL EXAMPLE 7

| IN-PLANE AVERAGE VOLUME [pl] | | | | M1+M2 | M1+M3 | M1+M4 | M2+M3 | M2+M4 | M3+M4 | \|M1-M2\| | \|M1-M3\| | \|M1-M4\| | \|M2-M3\| | \|M1-M4\| | \|M3-M4\| | IMAGE OFFSET |
|---|---|---|---|---|---|---|---|---|---|---|---|---|---|---|---|---|
| M1 (MAGENTA) | M2 (BLACK) | M3 (CYAN) | M4 (YELLOW) | [pl] | [pl] | [pl] | [pl] | [pl] | [pl] | [pl] | [pl] | [pl] | [pl] | [pl] | [pl] | |
| 3 | 3 | 3 | 3 | 6 | 6 | 6 | 6 | 6 | 6 | 0 | 0 | 0 | 0 | 0 | 0 | Excellent |
| 3 | 3 | 3 | 6 | 6 | 6 | 9 | 6 | 9 | 9 | 0 | 0 | 3 | 0 | 3 | 3 | Excellent |
| 3 | 3 | 6 | 3 | 6 | 9 | 6 | 9 | 6 | 9 | 0 | 3 | 0 | 3 | 0 | 3 | Very Good |
| 3 | 6 | 3 | 3 | 9 | 6 | 6 | 9 | 9 | 6 | 3 | 0 | 0 | 3 | 3 | 0 | Very Good |
| 6 | 3 | 3 | 3 | 9 | 9 | 9 | 6 | 6 | 6 | 3 | 3 | 3 | 0 | 0 | 0 | Very Good |
| 3 | 3 | 3 | 9 | 6 | 6 | 12 | 6 | 12 | 12 | 0 | 0 | 6 | 0 | 6 | 6 | Average |
| 3 | 3 | 9 | 3 | 6 | 12 | 6 | 12 | 6 | 12 | 0 | 6 | 0 | 6 | 0 | 6 | Average |
| 3 | 9 | 3 | 3 | 12 | 6 | 6 | 12 | 12 | 6 | 6 | 0 | 0 | 6 | 6 | 0 | Average |
| 9 | 3 | 3 | 3 | 12 | 12 | 12 | 6 | 6 | 6 | 6 | 6 | 6 | 0 | 0 | 0 | Poor |

INKJET RECORDING APPARATUS AND INKJET RECORDING METHOD

BACKGROUND OF THE INVENTION

1. Field of the Invention

The present invention relates to an inkjet recording apparatus and an inkjet recording method, and more particularly, to an inkjet recording apparatus and an inkjet recording method which are able to suppress the occurrence of local offset after fixing by a heat roller.

2. Description of the Related Art

An inkjet recording apparatus is an apparatus which forms an image by continuously ejecting droplets of ink onto a recording medium, and since this kind of apparatus is able to record images of high quality by means of a simple composition, it is widely used both as a domestic printer for individual use and as an office printer for commercial use. In the case of office printers for commercial use, in particular, there are increasing demands for higher processing speed and higher image quality.

In an inkjet recording apparatus, if ink is made to undergo an aggregating reaction and the image is fixed by a heat roller in a state of containing a large amount of water, then there is a problem of offset of the image. In particular, if a large dot is formed and then a further large dot is superimposed on the portion where this large dot is formed, then the image (dot) height becomes relatively high and local offset occurs. In particular, in a recording method in which wetting and spreading of dots is suppressed by an aggregating reaction and high-speed printing is carried out by a one-pass recording method, the drying time is limited and this offset is especially marked.

Japanese Patent Application Publication No. 2008-100511 discloses an inkjet recording method in which an image is formed on a coated paper having a specified pure water transfer amount on the basis of a blister method, and after becoming touch dry, the image is fixed by a heating roller. In the method described in Japanese Patent Application Publication No. 2008-100511, since an image is formed on a coated paper having low permeability, then an image of high quality cannot be obtained. Furthermore, since this system is a non-aggregating system, then incorporation of water into the image is not liable to occur and the system is essentially beneficial in respect of offset. Therefore, the issue of local offset occurring when an aggregating reaction is applied to image formation onto a coated paper has not been recognized.

Furthermore, Japanese Patent Application Publication No. 2008-62503 describes an inkjet recording method and a recording apparatus which deposit a treatment liquid having a function of aggregating ink onto a coated paper. According to the image forming method and image forming apparatus described in Japanese Patent Application Publication No. 2006-82254, a head is disclosed in which drive waveform including drive signals for ejected droplet volumes Mj of Mj0, Mj1 and Mj2 (Mj0>Mj1>Mj2) is developed and output, and ejected droplet volumes of different sizes can be ejected. However, when performing two-way printing, the landing sequence of the liquid droplets is different in the outward printing action and the return printing action, and hence there is the decline in image quality, such as the occurrence of color differences, divergence of the color hues, and marked banding in the image.

However, Japanese Patent Application Publication No. 2008-62503 and Japanese Patent Application Publication No. 2006-82254 do not provide research into local offset occurring when an aggregating reaction is used in forming images onto coated paper.

SUMMARY OF THE INVENTION

The present invention has been contrived in view of these circumstances, an object thereof being to provide an inkjet recording apparatus and an inkjet recording method whereby it is possible to suppress the occurrence of local offset.

In order to attain an object described above, one aspect of the present invention is directed to an inkjet recording apparatus comprising: a treatment liquid deposition device which deposits on a recording medium a treatment liquid having a function to aggregate inks or increase viscosity of inks; an ink deposition device which includes a plurality of ink heads for ejecting the inks of at least two types in such a manner that the inks are deposited on the recording medium on which the treatment liquid has been deposited; and a heating-pressuring device which fixes the inks that have been deposited on the recording medium, wherein the ink deposition device ejects the inks from the plurality of ink heads in such a manner that following Relationships (A) and (B) are satisfied where $M_x$ represents in-plane average deposition volume of one of the inks that is priorly deposited on the recording medium, $M_y$ represents in-plane average deposition volume of another one of the inks that is subsequently deposited on the recording medium, and N represents number of the types of the inks ($1 \leqq x < y \leqq N$), Relationship (A): $M_x + M_y < 10$ picoliters; and Relationship (B): $|M_x - M_y| = 3$ picoliters.

According to this aspect of the invention, since the total droplet volume of the in-plane average deposition volume of the ink that is priorly deposited and the in-plane average deposition volume of the ink that is subsequently deposited is less than 10 pl, then it is possible to reduce portions where large droplets overlap with each other. In other words, since it is possible to reduce the dot height in the overlapping portion, then it is possible to suppress the occurrence of local offset.

Furthermore, as indicated in Relationship (B), since the absolute value of the difference between the in-plane average deposition volume of the ink that is priorly deposited and the in-plane average deposition volume of the ink that is subsequently deposited is 3 pl or less, then it is possible to lower the amount of water incorporated during aggregation, and therefore it is possible to suppress the occurrence of offset.

The "in-plane average deposition volume" means the average volume (average value) of liquid (an ink droplet) deposited on each dot which is assigned to the liquid on a recording medium, with respect to the whole dots where the liquid (ink droplets) is deposited.

Desirably, the in-plane average deposition volume of the one of the inks that is priorly deposited on the recording medium is 3 picoliters or less.

Local offset principally occurs due to surplus water content in the dot overlap portions, and also occurs due to decline in the strength of the coating layer of the coated paper as a result of permeation of water. In other words, the greater the volume of the priorly deposited dot, the greater the liability of water to permeate into the coating layer and degrade the strength with the passage of time until fixing is carried out, and hence local offset becomes worse. According to this aspect of the invention, since the in-plane average deposition volume of the priorly deposited ink is 3 pl or less, then it is possible to suppress permeation of water into the coating layer, and therefore deterioration of the strength of the coating layer is suppressed and occurrence of local offset can be suppressed.

Desirably, the inkjet recording apparatus further comprising a drying device which dries the inks that have been deposited on the recording medium, wherein the drying device dries the inks in such a manner that a water content rate of the inks after the drying device dries the inks is 4 g/m$^2$ or less.

According to this aspect of the invention, since the residual amount of water after drying by a drying device is 4 g/m$^2$ or less, then it is possible to remove the water content sufficiently during fixing, and therefore it possible to suppress local offset.

Desirably, total volume of the inks deposited on the recording medium is 13.5 g/m$^2$ or less.

According to the present embodiment, since the total ejected droplet volume of the ink is 13.5 g/m$^2$ or less, then it is possible to restrict energy consumption by drying. Furthermore, it is possible to suppress the occurrence of insufficiently dried portions, and hence the occurrence of local offset can be suppressed.

Desirably, the inkjet recording apparatus employs a one-pass recording method as a printing method.

According to the present embodiment, since the total volume of the in-plane average deposition volume of the priorly deposited ink and the subsequently deposited ink is a prescribed value or less, it is possible to suppress the occurrence of local offset even in a one-pass printing method in which the drying time is restricted, and this is beneficial.

Desirably, the recording medium is a coated paper.

According to the present embodiment, the occurrence of offset during fixing is suppressed by adjusting the ink volume, and therefore the present method can be used to particularly good effect with a coated paper which has a non-permeable membrane on the recording medium.

In order to attain an object described above, another aspect of the present invention is directed to an inkjet recording method comprising: a treatment liquid deposition step of depositing on a recording medium a treatment liquid having a function to aggregate inks or increase viscosity of inks; an ink deposition step of ejecting the inks of at least two types from a plurality of ink heads in such a manner that the inks are deposited on the recording medium on which the treatment liquid has been deposited; and a fixing step of fixing the inks that have been deposited on the recording medium, wherein the inks are deposited on the recording medium in such a manner that following relationships (A) and (B) are satisfied where $M_x$ represents in-plane average deposition volume of one of the inks that is priorly deposited on the recording medium, $M_y$ represents in-plane average deposition volume of another one of the inks that is subsequently deposited on the recording medium, and N represents number of the types of the inks ($1 \leqq x \leqq y \leqq N$), Relationship (A): $M_x+M_y<10$ picoliters; and Relationship (B): $|M_x-M_y|=3$ picoliters.

Desirably, the in-plane average deposition volume of the one of the inks that is priorly deposited on the recording medium is 3 picoliters or less.

Desirably, the inkjet recording method further comprises a drying step of drying the inks that have been deposited on the recording medium, wherein the inks are dried in such a manner that a water content rate of the inks after the drying step is 4 g/m$^2$ or less.

Desirably, total volume of the inks deposited on the recording medium is 13.5 g/m$^2$ or less.

Desirably, the in-plane average deposition volume of the one of the inks that is priorly deposited on the recording medium is 4.5 picoliters or less.

Desirably, the in-plane average deposition volume of the one of the inks that is priorly deposited on the recording medium is 4.8 picoliters or less.

Desirably, the in-plane average deposition volume of the another one of the inks that is subsequently deposited on the recording medium is 3 picoliters or less.

Desirably, the one of the inks that is priorly deposited on the recording medium has uniform in-plane deposition volume with respect to the recording medium.

Desirably, the one of the inks that is priorly deposited on the recording medium includes at least two types according to in-plane deposition volume, wherein one of the at least two types which has smallest in-plane deposition volume accounts for 60% or more of the one of the inks that is priorly deposited on the recording medium.

As described above, the present invention can be applied to inkjet recording apparatuses and inkjet recording methods, and according to such inkjet recording apparatuses and inkjet recording methods, the same or similar beneficial effects can be made.

According to inkjet recording apparatuses and inkjet recording methods of embodiments of the present invention, it is possible to reduce the portions of mutual overlap between large droplets after the ejection of ink droplets, in other words, the dot height in the overlapping portions can be lowered, and therefore it is possible to suppress the occurrence of local offset. Furthermore, by reducing the difference between the in-plane average deposition volume of the priorly deposited ink and the in-plane average deposition volume of the subsequently deposited ink, it is possible to reduce the amount of water incorporated during aggregation, and therefore the occurrence of offset can be suppressed.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 2 is a table indicating results of experimental examples 1-4;

FIG. 3 is a table indicating results of the experimental example 5;

FIG. 4 is a table indicating results of the experimental example 6; and

FIG. 5 is a table indicating results of the experimental example 7.

DETAILED DESCRIPTION OF THE PREFERRED EMBODIMENTS

Figure 1:
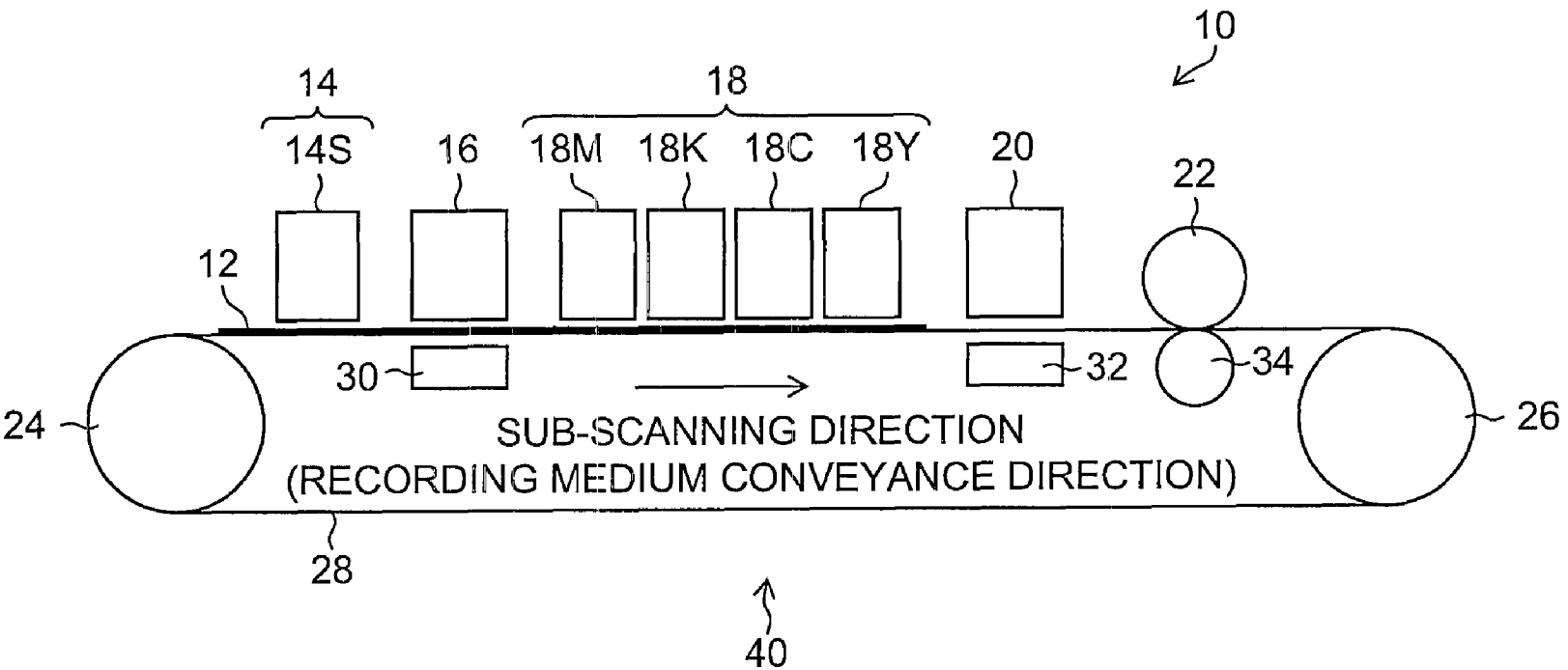
FIG. 1 is a schematic structural diagram illustrating an inkjet printing apparatus used for an inkjet recording method according to an embodiment of the present invention.

FIG. 1 illustrates a general schematic diagram of a direct recording type of inkjet recording apparatus used in an inkjet recording method according to the present invention. The image recording apparatus 10 illustrated in FIG. 1 employs a direct recording method in which an image is formed directly onto a recording medium 12.

The inkjet recording apparatus 10 comprises: a treatment liquid deposition unit 14 which deposits a treatment liquid onto a recording medium 12; a treatment liquid drying unit 16 which removes solvent in the treatment liquid thus deposited; an ink ejection unit 18 comprising ink heads 18M, 18K, 18C and 18Y which eject droplets of inks of respective colors of M, K, C and Y onto the recording medium 12 on which a layer of treatment liquid has been formed by the deposition of treatment liquid; an ink drying unit 20 which removes the solvent component remaining on the recording medium 12 onto which droplets of inks of the respective colors of M, K, C and Y have been ejected; and a fixing roller 22 which heats the image formed on the recording medium 12 to fix the image onto the recording medium 12. In FIG. 1, the treatment liquid deposition unit 14 corresponds to a treatment liquid deposition device, the ink ejection unit 18 corresponds to an ink deposition device, the drying unit 20 corresponds to a drying device, and the fixing roller 22 corresponds to a heating-pressuring device.

A recording medium 12 which is output from the paper supply unit (not illustrated) is supplied to a suction belt conveyance unit 40. The suction belt conveyance unit 40 has a structure in which an endless belt 28 is wound between rollers 24 and 26, and the portion of the belt which opposes the treatment liquid deposition unit 14, the treatment liquid drying unit 16, the ink ejection unit 18, the image fixing unit 20 and the fixing roller 22 is composed so as to form a horizontal surface (flat surface).

The belt 28 has a greater width than the recording medium 12, and a plurality of suction apertures (not illustrated) are formed in the belt surface. As illustrated in FIG. 1, a suction chamber (not illustrated) is provided on the inner side of the belt 28 which is wound about the rollers 24 and 26, at a position opposing the treatment liquid deposition unit 14, the treatment liquid drying unit 16, the ink ejection unit 18, the ink drying unit 20 and the image fixing unit 22. The recording medium 12 is suctioned and held on the belt 28 by creating a negative pressure by suctioning the suction chamber with a pump (not illustrated).

By transmitting the motive force of a motor (not illustrated) to at least one of the rollers 24, 26 about which the belt 28 is wound, the belt 28 is driven in the clockwise direction in FIG. 1 and the recording medium 12 held on the belt 28 is conveyed from left to right in FIG. 1.

Since ink adheres to the belt 28 when a marginless print job or the like is performed, a belt cleaning unit (not illustrated) is disposed in a predetermined position (a suitable position outside the printing area) on the exterior side of the belt 28. Although the details of the configuration of the belt cleaning unit (not illustrated) are not illustrated, examples thereof include a configuration in which the belt is nipped with a cleaning roller such as a brush roller and a water absorbent roller, an air blower configuration in which clean air is blown onto the belt, and a combination of these. In the case of a configuration in which the belt is nipped with a cleaning roller, it is desirable to make the linear velocity of the cleaning roller different to that of the belt, in order to improve the cleaning effect.

A recording head (treatment liquid head) 14S corresponding to the treatment liquid is provided in the treatment liquid deposition unit 14. The treatment liquid head 14S ejects the treatment liquid from an ejection face which opposes the recording medium 12. By this means, the treatment liquid is deposited on the recording medium 12. The method employed in the treatment liquid deposition unit 14 is not limited to a method which ejects the treatment liquid from a head having nozzles, and may also be an application method which uses an application roller. With this application method, the treatment liquid can be deposited readily onto virtually the whole surface of the recording medium 12 including the image region where the ink droplets are deposited. In this case, it is desirable that the thickness of the treatment liquid on the recording medium 12 be 1 μm to 5 μm. It is also possible to provide a device which makes the thickness of treatment liquid on the recording medium 12 uniform. For example, there is a method which uses an air knife, and a method in which a member having a sharp angle is disposed so as to create a gap corresponding to the designated value of the thickness of the treatment liquid with respect to the recording medium 12. In FIG. 1, the treatment liquid deposition unit 14 is provided before the ink ejection unit 18, but it may also be disposed after the ink ejection unit 18. Even if the treatment liquid deposition unit 14 is disposed after the ink ejection section 18, it is possible to obtain similar beneficial effects to a case where the treatment liquid deposition unit 14 is disposed before the ink ejection unit.

The treatment liquid drying unit 16 is disposed next. In the treatment liquid drying unit 16, drying of the solvent component in the treatment liquid after ejecting droplets of treatment liquid is carried out.

The ink ejection unit 18 is disposed next. The ink ejection unit 18 comprises recording heads (ink heads) 18M, 18K, 18C and 18Y which correspond to the respective colors of ink of magenta (M), black (K), cyan (C), and yellow (Y). Respective inks which satisfy the ink composition conditions according to embodiments of the present invention are stored in respective ink storage units (not illustrated) which correspond to the inks of respective colors, and these inks are supplied to the respective recording heads 18M, 18K, 18C and 18Y.

The ink heads 18M, 18K, 18C and 18Y respectively eject the ink of the corresponding color, from an ejection surface which opposes the recording medium 12. By this means, inks of respective colors are deposited on the recording surface of the recording medium 12.

Each of the treatment liquid head 14S and the ink heads 18M, 18K, 18C and 18Y is a full line head in which a plurality of ejection ports (nozzles) are formed through the maximum recording width of the image formed on the recording medium 12. Therefore, it is possible to record images at high speed on the recording medium 12, in comparison with a serial type of head which performs recording while scanning (moving) a short shuttle head back and forth in the breadthways direction of the recording medium 12 (e.g. the front to back direction with respect to the plane of the drawing in FIG. 1). Of course, embodiments of the present invention are also suitable for a serial system which has a relatively high recording speed, for example, a one-pass recording system which forms one line in one scanning action. Since the occurrence of local offset can be suppressed by adjusting the in-plane average deposition volume of ink according to embodiments of the present invention, embodiments of the present invention can be suitably applied to a one-pass recording method with the limited drying time.

In the present embodiment, all of the respective recording heads (the treatment liquid head 14S, and the ink heads 18M, 18K, 18C and 18Y) have the same structure, and hereinafter, the reference numeral 18 is used to indicate a representative example of these recording heads.

When the treatment liquid has been ejected onto the recording medium 12 from the treatment liquid head 14S, the region of the recording medium 12 on which the treatment liquid has been deposited is moved sequentially to directly below the ink heads 18M, 18K, 18C and 18Y, due to the rotation of the rollers 24, 26, and the inks of the corresponding colors are ejected respectively from the ink heads 18M, 18K, 18C and 18Y.

Desirably, the treatment liquid deposition volume and the ink deposition volume are adjusted in accordance with requirements.

According to an embodiment of the present invention, in the ink deposition device, the following two Relationships (A) and (B) are satisfied, taking the in-plane average deposition volume of the priorly deposited ink to be $M_x$ (pl:

picoliter(s)) and taking the in-plane average deposition volume of the subsequently deposited ink to be $M_y$ (pl).

$$M_x+M_y<10 \quad \text{Relationship (A):}$$

$$|Mx-My|\leqq 3 \ (1\leqq x\leqq y\leqq N, \text{ where droplets of inks of N types are ejected}). \quad \text{Relationship (B):}$$

In this way, by making the total volume of the in-plane average deposition volume of the priorly deposited ink and the in-plane average deposition volume of the subsequently deposited ink less than 10 pl, it is possible to reduce the overlapping portions between large droplets, and therefore the relative height of the image (dots) can be reduced and hence the occurrence of local offset can be suppressed. In particular, if the ink is aggregated using a treatment liquid, then the dot height increases because the wetting and spreading of the dots is suppressed. Consequently, by ejecting droplets in a range which satisfies Relationships (A) and (B), it is possible to reduce the height of the dots, and hence a more beneficial effect is obtained.

Furthermore, as indicated in Relationship (B), by making the absolute value of the difference between the in-plane average deposition volume of the ink that is priorly deposited and the in-plane average deposition volume of the ink that is subsequently deposited equal to or less than 3 pl, the ratio of the respective colors present on the medium can be made uniform and therefore it is possible to lower the amount of water incorporated during aggregation, and the occurrence of offset can be suppressed.

If the number of inks ejected is three or more, then the conditions Relationships (A) and (B) are satisfied for each respective ink. For example, in the case of three colors, the conditions in Relationships (A) and (B) are satisfied in respect of the ink that is deposited firstly and the ink that is deposited secondly, in respect of the ink that is deposited firstly and the ink that is deposited thirdly, and in respect of the ink that is deposited secondly and the ink that is deposited thirdly. In the case of four or more color, these conditions are satisfied in a similar fashion for each of the respective inks. In FIG. 1, a composition using ink heads of respective colors is described, but embodiments of the present invention may also be applied to a case where the color of ink ejected is the same, and to a case where printing is performed by dark and light tones of the same color.

Furthermore, desirably, the in-plane average deposition volume of the ink that is deposited firstly is 3 pl or less. By restricting the in-plane average deposition volume of the ink that is deposited firstly, it is possible to suppress permeation of water content into the recording medium (coated paper), and therefore local offset can be suppressed. Local offset also occurs due to deterioration in the strength of the coating layer of the coated paper. Consequently, the greater the volume of the priorly deposited dot, the greater the liability of water to permeate into the coating layer and degrade the strength with the passage of time until fixing is carried out, and hence local offset becomes worse.

Next, the solvent in the ink composition is removed by the ink drying unit 20, which is provided to the downstream side of the ink ejection unit 18. In FIG. 1, the solvent is removed by being heated by a hot air flow generated by the ink drying unit 20 from the upper surface of the applied film, and by a heating panel 32 which is provided on the opposite side of the recording medium 12 from the applied film. Embodiments of the present invention are not limited to these examples, and it is also possible to remove the solvent by means of a solvent removal roller or a heating roller.

Desirably, drying by the drying device reduces the residual amount of water in the ejected ink droplets to 4 g/m$^2$ or less. Consequently, it is desirable that the total ink ejection volume should be 13.5 g/m$^2$ or less. By setting the total ink ejection volume to the range stated above, it is possible to make the residual amount of water in the ink 4 g/m$^2$ or less in the drying process by the drying device. If the total ink ejection volume exceeds 13.5 g/m$^2$, then it is difficult to dry the ink to 4 g/m$^2$ or less due to restrictions such as energy consumption, and the like. Furthermore, since the total ejection volume is originally large, then even if the remaining amount of water is dried to 4 g/m$^2$ or less, non-uniformities occur in drying and insufficiently dried portions are liable to arise, causing local offset to become worse. The adjustment of the remaining amount of water by means of a drying device can be controlled on the basis of conditions such as the drying temperature, drying time, and so on.

Next, the ink is fixed onto the recording medium 12 by heating/pressurizing the ink droplets which have been ejected onto the recording medium 12, by the image fixing unit 22.

In the image fixing unit 22, two fixing rollers 22, 34 are provided respectively on the front and rear surfaces of the recording medium 12, and by pressurizing and heating the image formed on the recording medium 12 by these fixing rollers 22 and 34, it is possible to improve the fixing properties of the recorded image on the recording medium 12. Desirably, the fixing rollers 22 and 34 are a pair of rollers which comprise one pressurizing and heating roller and one heating roller, but the fixing rollers are not limited to these. According to embodiments of the present invention, the height of the dots is lowered by adjusting the in-plane average deposition volume of the ink, and therefore it is possible to suppress the occurrence of local offset in the image fixing unit 22.

The constituent elements which are omitted from the illustration in FIG. 1 include: a decurling unit which removes curl in the recording medium 12 supplied from the paper supply unit; a cutter which cuts a recording medium to a prescribed size if a long recording medium (roll-shaped recording medium) is used, and the like.

Inkjet recording apparatuses and the inkjet recording methods in accordance with embodiments of the present invention are described hereinabove in details; however, the present invention is not limited to the above-described examples and it goes without saying that various modification and changes may be made without departing from the scope of the present invention.

Recording Medium

There are no particular restrictions on the recording medium which is used in embodiments of the present invention. However, by satisfying Relationships (A) and (B) stated above, the height of the dots upon ejection of droplets can be restricted, the amount of water incorporated during aggregation is restricted and the occurrence of offset can be suppressed, and therefore, it is possible to obtain particularly desirable effects when using a coated printing paper which has slow permeation of the ink solvent. The applicability of the recording medium 12 is not limited to a medium having non-permeable properties, and it is also possible to use a medium having poor permeability compared to a medium having permeable properties, such as normal paper.

Possible examples of support media which can be used appropriately for coated paper are: a base paper manufactured using a Fourdrinier paper machine, cylindrical-wire paper machine, twin-wire paper machine, or the like, from main components of wood pulp or pigment, the pulp being either a chemical pulp such as LBKP or NBKP, a mechanical pulp, such as GP, PGW, RMP, TMP, CTMP, CMP, CGP, or the like, or recovered paper pulp, such as DIP, and the main components being mixed with one or more additive of a sizing agent, fixing agent, yield enhancer, cationization agent, paper strength enhancer, or the like, or a base paper provided with a size press layer or anchor coating layer formed using starch, polyvinyl alcohol, or the like, or an art paper, coated paper, or cast coated paper, or the like, formed by providing a coating layer on top of the size press layer or anchor coating layer.

In the present embodiment, it is possible to use these base papers or coated papers directly without alteration, and it is also possible to use these papers after carrying out a calendering process using a machine calender, TG calender, soft calender, or the like, and thereby controlling the surface smoothness of the paper.

There are no particular restrictions on the weight of the support medium, although generally the weight is approximately 40 g/m$^2$ to 300 g/m$^2$. The coated paper used in the present embodiment has the coating layer formed on the support medium described above. The coating layer includes a coating composition having a main component of pigment and binder, and at least one layer thereof is formed on the support medium.

For the pigment, it is desirable to use a white pigment. Possible examples of the white pigment are: an inorganic pigment, such as precipitated calcium carbonate, heavy calcium carbonate, magnesium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic non-crystalline silica, colloidal silica, alumina, colloidal alumina, pseudo-boehmite, aluminum hydroxide, lithopone, zeolite, hydrated halloysite, magnesium hydroxide, or the like; or an organic pigment, such as a styrene-based plastic pigment, an acrylic plastic pigment, polyethylene, microcapsules, urea resin, melamine resin, or the like.

Possible examples of the binder are: a starch derivative, such as oxidized starch, etherified starch, or phosophoric acid esterized starch; a cellulose derivative, such as carboxymethyl cellulose, hydroxyethyl cellulose, or the like; casein, gelatine, soybean protein, polyvinyl alcohol, or derivatives of same; polyvinyl alcohols having various degrees of saponification or silanol-denatured versions of same, or carboxylates, cationized products, of other derivatives of same; polyvinyl pyrrolidone, maleic anhydride resin, a styrene-butadiene copolymer, a methyl methacrylate-butadiene copolymer, or other conjugated diene copolymer latex; an acrylic polymer latex, such as a polymer or copolymer of acrylate ester and methacrylate ester; a vinyl polymer latex, such as such as an ethylene acetate vinyl copolymer; or a functional group-denatured polymer latex based on these various polymers and a monomer containing a functional group such as a carboxy group; an aqueous adhesive of a heat-curable synthetic resin, such as melamine resin, urea resin, or the like; an acrylate ester such as polymethylmethacrylate; methacrylate ester polymer or copolymer resin, such as methacrylate ester; or a synthetic resin-based adhesive, such as polyurethane resin, unsaturated polyester resin, vinyl chloride-vinyl acetate copolymer, polyvinyl butylal, alkyd resin, or the like.

The combination ratio of the pigment and binder in the coating layer is 3 to 70 parts by weight, and desirably 5 to 50 parts by weight, of binder with respect to 100 parts by weight of pigment. If the combination ratio of the binder with respect to 100 parts by weight of pigment is less than 3 parts by weight, then the coating of the ink receiving layer by the coating composition will have insufficient strength. On the other hand, if the combination ratio is greater than 70 parts by weight, then the absorption of high-boiling-point solvent is slowed dramatically.

Moreover, it is also possible to combine various additives in appropriate fashion in the coating layer, such as: a dye fixing agent, a pigment dispersant, a viscosity raising agent, a fluidity enhancer, an antifoaming agent, a foam suppressant, a separating agent, a foaming agent, a permeating agent, a coloring dye, a coloring pigment, a fluorescent brightener, an ultraviolet light absorber, an antioxidant, an anticorrosive, an antibacterial agent, a waterproofing agent, a wet paper strength enhancer, a dry paper strength enhancer, or the like.

The application amount of the ink receiving layer varies depending on the required luster, the ink absorbing properties and the type of support medium, or the like, and although no general figure can be stated, it is normally 1 g/m$^2$ or greater. Furthermore, the ink receiving layer can also be applied by dividing a certain uniform application amount into two application steps. If application is divided into two steps in this way, then the luster is raised in comparison with a case where the same application amount is applied in one step.

The application of the coating layer can be carried out using one of various types of apparatus, such as a blade coater, roll coater, air knife coater, bar coater, rod blade coater, curtain coater, short dowel coater, size press, or the like, in on-machine or off-machine mode. Furthermore, after application of the coating layer, it is also possible to carry out a smoothing and finishing process on the ink receiving layer by using a calender apparatus, such as a machine calender, a TG calender, a soft calender, or the like. The number of coating layers can be determined appropriately in accordance with requirements.

The coating paper may be an art paper, high-quality coated paper, medium-quality coated paper, high-quality lightweight coated paper, medium-quality lightweight coated paper, or light-coated printing paper; the application amount of the coating layer is around 40 g/m$^2$ on both surfaces in the case of art paper, around 20 g/m$^2$ on both surfaces in the case of high-quality coated paper or medium-quality coated paper, around 15 g/m$^2$ on both surfaces in the case of high-quality lightweight coated paper or medium-quality lightweight coated paper, and 12 g/m$^2$ or less on both surfaces in the case of a light-coated printing paper. An example of an art paper is Tokubishi Art, or the like; an example of a high-quality coated paper is "Urite"; examples of art papers are Tokubishi Art (made by Mitsubishi Paper Mills), Golden Cask Satin (made by Oji Paper), or the like; examples of coated papers are OK Top Coat (made by Oji Paper), Aurora Coat (made by Nippon Paper Group), Recycle Coat T-6 (made by Nippon Paper Group); examples of lightweight coated papers are Urite (made by Nippon Paper Group), New V Matt (made by Mitsubishi Paper Mills), New Age (made by Oji Paper), Recycle Mat T-6 (made by Nippon Paper Group), and "Pism" (made by Nippon Paper Group). Examples of light-coated printing papers are Aurora L (made by Nippon Paper Group) and Kinmari Hi-L (made by Hokuetsu Paper Mills), or the like. Moreover, examples of cast coated papers are: SA Gold Cask plus (made by Oji Paper), Hi-McKinley Art (Gojo Paper Manufacturing), or the like.

The recording media used in the embodiment of the present invention are not limited to the coated paper, and it is possible to use the following recording media. The preferred examples of the recording media include gloss or mat paper such as board paper, cast coated paper, art paper, high-grade paper, copy paper, recycled paper, synthetic paper, wood-containing paper, pressure-sensitive paper, and emboss paper. Special inkjet paper can be also used. Further, resin film and metal deposited film can be also used. More specific preferred examples include paper with a weight of 60 g/m$^2$ to 350 g/m$^2$ such as OK Ercard+ (manufactured by Oji Paper), SA Kanefuji+ (manufactured by Oji Paper), Satin Kanefuji N (manufactured by Oji Paper), OK Top Coat+ (manufactured by Oji Paper), New Age (manufactured by Oji Paper), Tokuhishi Art Both-sides N (manufactured by Mitsubishi Paper Mills), Tokuhishi Art Single-side N (manufactured by Mitsubishi Paper Mills), New V Mat (manufactured by Mitsubishi Paper Mills), Aurora Coat (manufactured by Nippon Paper Industries), Aurora L (manufactured by Nippon Paper Industries), U-Light (manufactured by Nippon Paper Industries), Recycle Coat T-6 (manufactured by Nippon Paper Industries), Recycle Mat T-6 (manufactured by Nippon Paper Industries), Ivest W (manufactured by Nippon Paper Industries), Invercoat M (manufactured by SPAN CORPORATION), High McKinley Art (manufactured by Gojo Paper Mfg), Kinmari Hi-L (manufactured by Hokuetsu Paper Mills), Signature True (manufactured by Newpage Corporation), Sterling Ultra (manufactured by Newpage Corporation), Anthem (manufactured by Newpage Corporation), Hanno ArtSilk (manufactured by Sappi), Hanno Art Gross (manufactured by Sappi), Consort Royal Semimatt (manufactured by Scheufelen), Consort Royal Gross (manufactured by Scheufelen), Zanders Ikon Silk (manufactured by m-real), Zanders Ikon Gross (manufactured by m-real).

Aqueous Ink

The aqueous ink used in the embodiment of the present invention will be described below in greater detail. The aqueous ink contains at least a resin dispersant (A), a pigment (B) that is dispersed by the resin dispersant (A), self-dispersible polymer particles (C), and an aqueous liquid medium (D).

Resin Dispersant (A)

The resin dispersant (A) is used as a dispersant for the pigment (B) in the aqueous liquid medium (D) and may be any appropriate resin, provided that it can disperse the pigment (B). The preferred structure of the resin dispersant (A) includes a hydrophobic structural unit (a) and a hydrophilic structural unit (b). If necessary, the resin dispersant (A) can also include a structural unit (c) that is different from the hydrophobic structural unit (a) and hydrophilic structural unit (b).

As for the compounding ratio of the hydrophobic structural unit (a) and hydrophilic structural unit (b), it is preferred that the hydrophobic structural unit (a) takes more than 80 wt %, desirably 85 wt % or more of the total weight of the resin dispersant (A). Thus, the compounding ratio of the hydrophilic structural unit (b) has to be not more than 15 wt %. Where the compounding ratio of the hydrophilic structural unit (b) is more than 15 wt %, the amount of component that is independently dissolved in the aqueous liquid medium (D), without participating in the dispersion of the pigment, increases, thereby causing degradation of performance such as dispersivity of the pigment (B) and worsening the ejection ability of ink for inkjet recording.

The preferred specific examples of the resin dispersant (A) used in the embodiment of the present invention are presented below, but the present invention is not limited thereto.

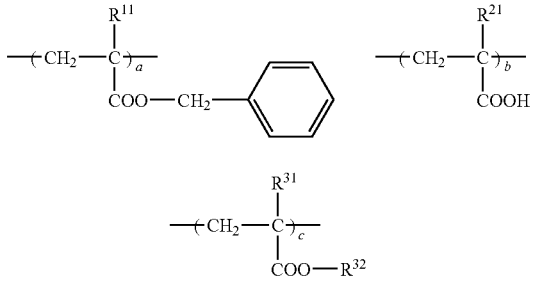

| | $R^{11}$ | $R^{21}$ | $R^{31}$ | $R^{32}$ | a | b | c | Mw |
|---|---|---|---|---|---|---|---|---|
| B-1 | $CH_3$ | $CH_3$ | $CH_3$ | $—CH_3$ | 60 | 10 | 30 | 46000 |
| B-2 | H | H | H | $—CH_3$ | 60 | 10 | 30 | 50000 |
| B-3 | $CH_3$ | $CH_3$ | $CH_3$ | $—CH_2CH_3$ | 61 | 10 | 29 | 43000 |
| B-4 | $CH_3$ | $CH_3$ | $CH_3$ | $—CH_2CH_2CH_2CH_3$ | 61 | 9 | 30 | 51000 |
| B-5 | $CH_3$ | $CH_3$ | $CH_3$ | $—CH_2(CH_3)CH_3$ | 60 | 9 | 31 | 96000 |
| B-6 | H | H | H | $—CH_2(CH_3)(CH_3)CH_3$ | 60 | 10 | 30 | 32000 |
| B-7 | $CH_3$ | $CH_3$ | $CH_3$ | $—CH_2CH(CH_3)CH_3$ | 60 | 5 | 30 | 75000 |

(a, b and c represent respective compositions (wt %))

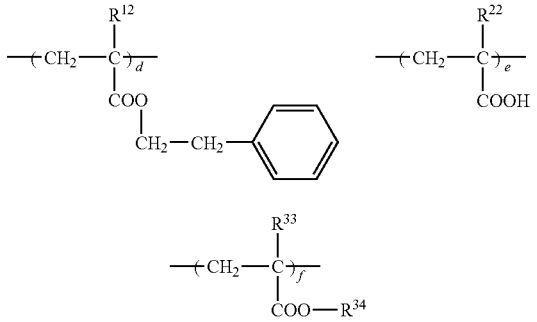

| | $R^{12}$ | $R^{22}$ | $R^{33}$ | $R^{34}$ | d | e | f | Mw |
|---|---|---|---|---|---|---|---|---|
| B-8 | $CH_3$ | $CH_3$ | $CH_3$ | $—CH_3$ | 55 | 12 | 33 | 31000 |
| B-9 | H | H | H | —CH2CH(CH3)CH3 | 70 | 10 | 20 | 34600 |

(d, e and f represent respective compositions (wt %))

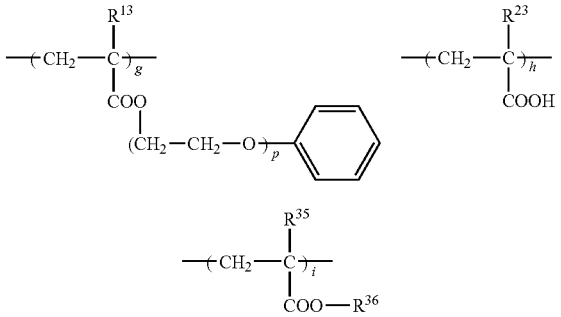
| | $R^{13}$ | p | $R^{23}$ | $R^{35}$ | $R^{36}$ | g | h | i | Mw |
|---|---|---|---|---|---|---|---|---|---|
| B-10 | $CH_3$ | 1 | $CH_3$ | $CH_3$ | —$CH_3$ | 60 | 9 | 31 | 35500 |
| B-11 | H | 1 | H | H | —$CH_2CH_3$ | 69 | 10 | 21 | 41200 |
| B-12 | $CH_3$ | 2 | $CH_3$ | $CH_3$ | —$CH_3$ | 70 | 11 | 19 | 68000 |
| B-13 | $CH_3$ | 4 | $CH_3$ | $CH_3$ | —$CH_2(CH_3)CH_3$ | 70 | 7 | 23 | 72000 |
| B-14 | H | 5 | H | H | —$CH_3$ | 70 | 10 | 20 | 86000 |
| B-15 | H | 5 | H | H | —$CH_2CH(CH_3)CH_3$ | 70 | 2 | 28 | 42000 |
(g, h and i represent respective compositions (wt %))
B-16
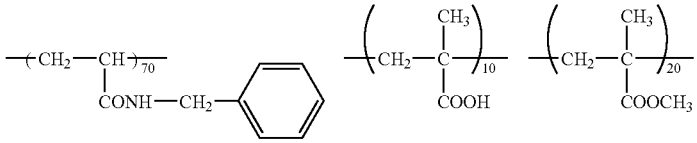
Mw: 34300
| | | Mw |
|---|---|---|
| B-17 | 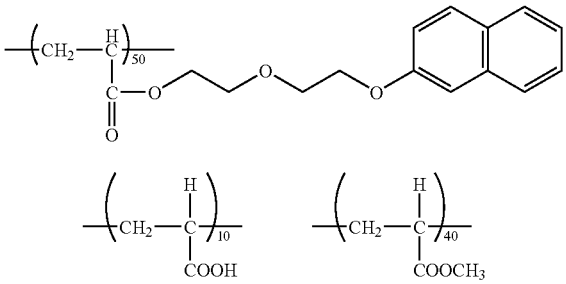 | 72400 |
| B-18 | 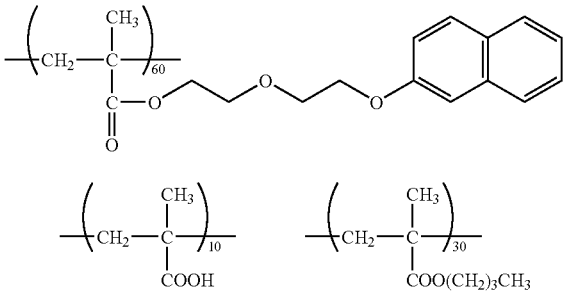 | 33800 |

-continued

B-19 39200

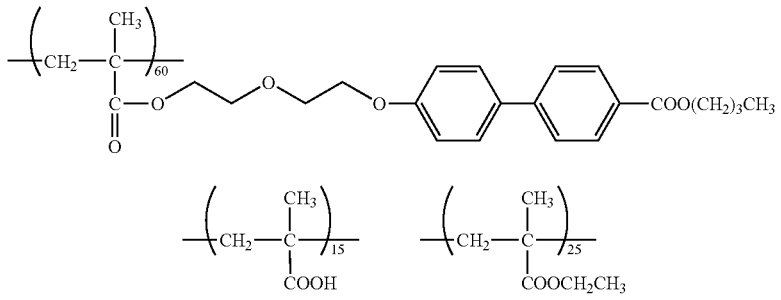

B-20 55300

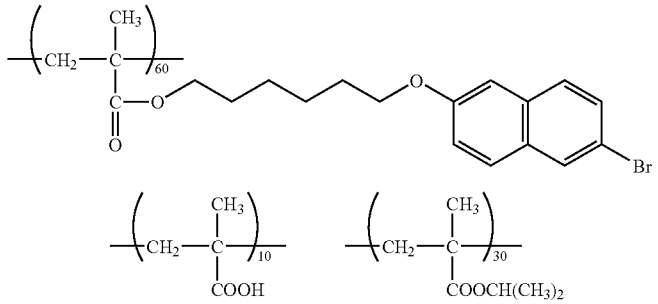

Ratio of Pigment (B) and Resin Dispersant (A)

The weight ratio of the pigment (B) and resin dispersant (A) is desirably 100:25 to 100:140, more desirably 100:25 to 100:50. When the resin dispersant is present at a ratio not lower than 100:25, the dispersion stability and abrasion resistance tend to improve, and where the resin dispersant is present at a ratio of 100:140 or less, the dispersion stability tends to improve.

Pigment (B)

In the embodiment of the present invention, the pigment (B) is a general term for color substances (including white color when the pigment is inorganic) that are practically insoluble in water and organic solvents, as described in Kagaku Daijiten (third edition), published on Apr. 1, 1994, (ed. by Michinori Old), p. 518, and organic pigments and inorganic pigments can be used in the embodiment of the present invention.

Further, "the pigment (B) dispersed by the resin dispersant (A)" in the description of the embodiment of the present invention means a pigment that is dispersed and held by the resin dispersant (A) and is desirably used as a pigment that is dispersed and held by the resin dispersant (A) in the aqueous liquid medium (D). An additional dispersant may be optionally contained in the aqueous liquid medium (D).

The pigment (B) dispersed by the resin dispersant (A) used in the embodiment of the present invention is not particularly limited, provided that it is a pigment that is dispersed and held by the resin dispersant (A). From the standpoint of pigment dispersion stability and ejection stability, microcapsulated pigments produced by a phase transition method are more preferred from among the aforementioned pigments.

A microcapsulated pigment represents a preferred example of the pigment (B) employed in the embodiment of the present invention. The microcapsulated pigment as referred to herein is a pigment coated by the resin dispersant (A).

The resin of the microcapsulated pigment has to use the resin dispersant (A), but it is preferred that a polymer compound having self-dispersibility or solubility in water and also having an anionic (acidic) group be used in a resin other than the resin dispersant (A).

The following pigments can be used in the embodiment of the present invention. Thus, examples of yellow ink pigments include C. I. Pigment Yellow 1, 2, 3, 4, 5, 6, 7, 10, 11, 12, 13, 14, 14C, 16, 17, 24, 34, 35, 37, 42, 53, 55, 65, 73, 74, 75, 81, 83, 93, 95, 97, 98, 100, 101, 104, 108, 109, 110, 114, 117, 120, 128, 129, 138, 150, 151, 153, 154, 155, 180.

Examples of magenta ink pigments include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 48 (Ca), 48 (Mn), 48:2, 48:3, 48:4, 49, 49:1, 50, 51, 52, 52:2, 53:1, 53, 55, 57 (Ca), 57:1, 60, 60:1, 63:1, 63:2, 64, 64:1, 81, 83, 87, 88, 89, 90, 101 (Bengal), 104, 105, 106, 108 (cadmium red), 112, 114, 122 (quinacridone magenta), 123, 146, 149, 163, 166, 168, 170, 172, 177, 178, 179, 184, 185, 190, 193, 202, 209, 219. Among them, C. I. Pigment Red 122 is especially preferred.

Examples of cyan ink pigments include C. I. Pigment Blue 1, 2, 3, 15, 15:1, 15:2, 15:3, 15:4, 16, 17:1, 22, 25, 56, 60, C. I. Vat Blue 4, 60, 63. Among them, C. I. Pigment Blue 15:3 is especially preferred.

Examples of other color ink pigments include C. I. Pigment Orange 5, 13, 16, 17, 36, 43, 51, C. I. Pigment Green 1, 4, 7, 8, 10, 17, 18, 36, C. I. Pigment Violet 1 (Rhodamine Lake), 3, 5:1, 16, 19 (quinacridone red), 23, 28. Processed pigments such as graft carbon that are obtained by treating the pigment surface with a resin or the like can be also used.

Carbon black is an example of a black pigment. Specific examples of carbon black include No. 2300, No. 900, MCF88, No. 33, No. 40, No. 45, No. 52, MA 7, MA8, MA100, and No. 2200B manufactured by Mitsubishi Chemical, Raven 5750, Raven 5250, Raven 5000, Raven 3500, Raven 1255, and Raven 700 manufactured by Colombia, Regal 400R, Regal 1330R, Regal 1660R, Mogul L, Monarch 700, Monarch 800, Monarch 880, Monarch 900, Monarch 1000, Monarch 1100, Monarch 1300, and Monarch 1400 manufactured by Cabot Corp., and Color Black FW1, Color Black FW2, Color Black FW2V, Color Black FW18, Color Black FW200, Color Black S150, Color Black S160, Color Black S170, Printex 35, Printex U, Printex V, Printex 140U, Special Black 6, Special Black 5, Special Black 4A, and Special Black 4 manufactured by Degussa Co., Ltd.

The aforementioned pigments may be used individually or in combinations obtained by selecting a plurality of pigments in each of the above-described groups or a plurality of pigments from different groups.

From the standpoint of dispersion stability and concentration of the aqueous ink, the content ratio of the pigment (B) in the aqueous ink used in the embodiment of the present invention is desirably 1 wt % to 10 wt %, more desirably 2 wt % to 8 wt %, and even more desirably 2 wt % to 6 wt %.

Self-Dispersible Polymer Particles (C)

The aqueous ink used in the embodiment of the present invention includes self-dispersible polymer particles of at least one kind. Self-dispersible polymer particles as referred to herein mean particles of a water-insoluble polymer containing no free emulsifying agent, this water-insoluble polymer being capable of assuming a dispersion state in an aqueous medium under the effect of functional groups (especially acidic groups or salt thereof) of the resin itself, without the presence of another surfactant.

The dispersion state as referred to herein includes both an emulsion state (emulsion) in which the water-insoluble polymer is dispersed in a liquid state in the aqueous medium and a dispersion state (suspension) in which the water-insoluble polymer is dispersed in a solid state in the aqueous medium.

From the standpoint of ink stability and ink aggregation speed in the case the water-insoluble polymer is contained in a water-soluble ink, it is preferred that the water-insoluble polymer used in the embodiment of the present invention be a water-insoluble polymer that can assume a dispersion state in which the water-insoluble polymer is dispersed in a solid state.

The self-dispersible polymer particles used in the embodiment of the present invention include a structural unit derived from a (meth)acrylate monomer including an aromatic group, and the content ratio thereof is desirably 10 wt % to 95 wt %. Where the content ratio of the (meth)acrylate monomer including an aromatic group is 10 wt % to 95 wt %, the stability of self-emulsion or dispersion state is improved. In addition, the increase in ink viscosity can be inhibited.

In the embodiment of the present invention, from the standpoint of stability of the self-dispersion state, stabilization of particle shape in the aqueous medium by hydrophobic interaction of aromatic rings with each other, and decrease in the amount of water-soluble components caused by adequate hydrophobization of the particles, it is preferred that the content ratio of the (meth)acrylate monomer including an aromatic group be 15 wt % to 90 wt %, desirably 15 wt % to 80 wt %, more desirably 25 wt % to 70 wt %.

The self-dispersible polymer particles used in the embodiment of the present invention can be configured, for example, by a structural unit including a monomer having an aromatic group and a structural unit including a monomer having a dissociative group. If necessary, the particles may also include other structural units.

The molecular weight range of the water-insoluble polymer constituting the self-dispersible polymer particles used in the embodiment of the present invention is desirably 3000 to 200,000, more desirably 50000 to 150,000, even more desirably 10,000 to 100,000, as a weight-average molecular weight. Where the weight-average molecular weight is not less than 3000, the amount of water-soluble components can be effectively inhibited. Where the weight-average molecular weight is not more than 200,000, self-dispersion stability can be increased. The weight-average molecular weight can be measured by gel permeation chromatography (GPC).

From the standpoint of controlling the hydrophilicity and hydrophobicity of the polymer, it is preferred that the water-insoluble polymer constituting the self-dispersible polymer particles used in the embodiment of the present invention include a (meth)acrylate monomer including an aromatic group at a copolymerization ratio of 15 wt % to 90 wt %, a monomer including a carboxyl group, and a monomer including an alkyl group, have an acid value of 25 to 100, and have a weight-average molecular weight of 3000 to 200,000. It is even more preferred that the water-insoluble polymer constituting the self-dispersible polymer particles include a (meth) acrylate monomer including an aromatic group at a copolymerization ratio of 15 wt % to 80 wt %, a monomer including a carboxyl group, and a monomer including an alkyl group, have an acid value of 25 to 95, and have a weight-average molecular weight of 5000 to 150,000.

The mean particle size of the self-dispersible polymer particles used in the embodiment of the present invention is desirably within a range of 10 nm to 400 nm, more desirably 10 nm to 200 nm, and even more desirably 10 nm to 100 nm. Particles with a mean size of 10 nm or more are more suitable for manufacture. Where the mean particle size is not more than 400 nm, stability in storage is improved.

The particle size distribution of the self-dispersible polymer particles used in the embodiment of the present invention is not particularly limited, and particles with a wide particle size distribution or a monodisperse particle size distribution may be used. Furthermore, water-insoluble particles of two or more kinds may be used as a mixture.

The mean particle size and particle size distribution of the self-dispersible polymer particles can be measured, for example, by using a light scattering method.

The self-dispersible polymer particles used in the embodiment of the present invention can be advantageously contained in an aqueous ink composition, and the particles of one kind may be used individually, or particles of two or more kinds may be used together.

Aqueous Liquid Medium (D)

In the aqueous ink of the inkjet recording system, the aqueous liquid medium (D) represents a mixture of water and a water-soluble organic solvent. The water-soluble organic solvent (also can be referred to hereinbelow as "solvent medium") is used as a drying preventing agent, wetting agent, and penetrating agent.

The ink composition uses the water-soluble solvent for the purpose of a drying prevention agent, wetting agent or permeation promoting agent. In particular, in the case of the aqueous ink composition used in the inkjet recording method, it is desirable to use an organic water-soluble solvent, for the purpose of a drying prevention agent, wetting agent or permeation promoting agent.

A drying prevention agent or wetting agent is used with a view to preventing blockages caused by drying of the inkjet ink in the ink ejection ports of the nozzles, and it is desirable to use an organic water-soluble solvent having a lower vapor pressure than water as the drying prevention agent or wetting agent.

Furthermore, it is also desirable to use an organic water-soluble solvent as a permeation promotion agent, in order that the ink composition (the inkjet ink composition in particular) permeates more satisfactorily into the paper.

In the present embodiment, in order to suppress curl, (a) the water-soluble solvent contains 90 wt % or more of water-soluble solvent having the SP value of 27.5 or lower, and contains a compound expressed by the structural formula (1) below. Here, the "water-soluble solvent having the SP value of 27.5 or lower" and the "compound expressed by the structural formula (1)" may be the same substance or different substances.

The SP value (solubility parameter) of the water-soluble solvent described here is a value expressed as the square root of the molecular aggregation energy, and this value can be calculated by the method described by R. F. Fedors in Polymer Engineering Science, 14, p. 147 (1974). The unit is $(MPa)^{1/2}$ and indicates the value at 25° C.

Structural formula (1)

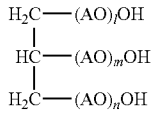

In the structural formula (1), l, m and n are respective and independent natural numbers, and l+m+n=3 to 15.

If l+m+n is less than 3, the curl suppressing force is low, and if this sum is greater than 15, then the ejection characteristics decline.

In the foregoing, desirably, l+m+n is 3 to 12, and more desirably, 3 to 10.

In the structural formula (I), AO represents ethylene oxy and/or propylene oxy, and of these, a propylene oxy group is desirable.

The AO in $(AO)_l$, $(AO)_m$ and $(AO)_n$ may be respectively the same or different.

Examples of water-soluble solvents having the above-described structure and an SP value of 27.5 or lower are listed as follows, together with their SP values in parentheses.

diethylene glycol monoethyl ether (22.4)
diethylene glycol monobutyl ether (21.5)
triethylene glycol monobutyl ether (21.1)
dipropylene glycol monomethyl ether (21.3)
dipropylene glycol (27.2)

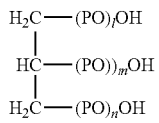

l + m + n = 3 (26.4)

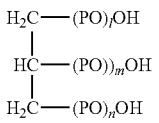

l + m + n = 4 (24.9)

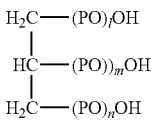

l + m + n = 5 (23.9)

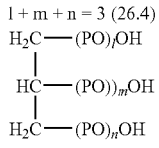

l + m + n = 6 (23.2)

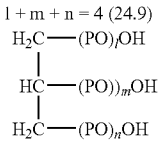

l + m + n = 7 (22.6)

(PO: Propylene Oxide)

$nC_4H_9O(AO)_4$—H (AO=EO or PO, ratio 1:1) (20.1)
EO=ethylene oxy (oxyethylene)

$nC_4H_9O(AO)_{10}$—H (as above) (18.8)

$HO(A'O)_{40}$—H (A'O=EO or PO, ratio EO:PO=1:3) (18.7)

$HO(A''O)_{55}$—H (A"O=EO or PO, ratio EO:PO=5:6) (18.8)

$HO(PO)_3H$ (24.7)

$HO(PO)_7H$ (21.2)

1,2 hexanediol (27.4)

The ratio (content) of the compound expressed by the structural formula (1) in the water-soluble solvent is desirably 10% or greater, more desirably, 30% or greater and even more desirably, 50% or greater. No problems occur, even if a high value is adopted.

Using a value in the above-described ranges is desirable, since this makes it possible to suppress curl without degrading the stability or ejection characteristics of the ink.

Furthermore, in embodiments of the present invention, other solvents can be used additionally, in a range where the ratio of solvent having an SP value of 27.5 or lower does not become lower than 90%.

The water-soluble organic solvents may be used individually or in mixtures of two or more thereof.

From the standpoint of ensuring stability and ejection characteristic, the content ratio of the water-soluble organic solvent in the ink is desirably not less than 1 wt % and not more than 60 wt %, more desirably not less than 5 wt % and not more than 40 wt %, yet more desirably not less than 10 wt % and not more than 30 wt %.

The amount of water added to the ink is not particularly limited; however, from the standpoint of ensuring stability and ejection characteristic, it is desirably not less than 10 wt % and not more than 99 wt %, more desirably not less than 30 wt % and not more than 80 wt %, and yet more desirably not less than 50 wt % and not more than 70 wt %.

Surfactant

It is preferred that a surfactant (can be also referred to hereinbelow as "surface tension adjusting agent") be added to the aqueous ink used in the embodiment of the present invention. Examples of surfactants include nonionic, cationic, anionic, and betaine surfactants. The amount of the surface tension adjusting agent added to the ink is desirably such as to adjust the surface tension of the aqueous ink used in the embodiment of the present invention to 20 mN/m to 60 mN/m, more desirably to 20 mN/m to 45 mN/m, and even more desirably to 25 mN/m to 40 mN/m, in order to eject the ink with an ink jet.

A compound having a structure having a combination of a hydrophilic portion and a hydrophobic portion in a molecule can be effectively used as the surfactant, and anionic surfactants, cationic surfactants, amphoteric surfactants, and nonionic surfactants can be used. Furthermore, the above-described polymer substance (polymer dispersant) can be also used as the surfactant.

Other Components

The aqueous ink used in the embodiment of the present invention may also include other additives. Examples of other additives include such well-known additives as an ultraviolet absorbent, a fading preventing agent, an antimold agent, a pH adjusting agent, an antirust agent, an antioxidant, an emulsion stabilizer, a preservative, an antifoaming agent, a viscosity adjusting agent, a dispersion stabilizer, and a chelating agent.

Treatment Liquid

The aqueous treatment liquid used in the embodiment of the present invention contains at least one solidifying agent which solidifies the components in the aqueous ink. The solidifying agent used in the present embodiment is able to solidify (aggregate) the aqueous ink by making contact with the aqueous ink on the paper. For example, by applying the aqueous treatment liquid, droplets of the aqueous ink are deposited in a state where the solidifying agent is present on the paper and they make contact with the solidifying agent, whereby the component in the aqueous ink can be made to aggregate and solidify on the paper.

Since it is desirable to be able to solidify (aggregate) the aqueous ink, desirably, the treatment liquid is a material that dissolves readily in the aqueous ink upon making contact with the aqueous ink and from this viewpoint, a polyvalent metallic salt having high water solubility is more desirable and an acidic material having high water solubility is also desirable. Furthermore, from the viewpoint of solidifying the whole of the ink by reacting with the aqueous ink, a bivalent or higher-valence acidic material is especially desirable. Moreover, for the solidifying agent, it is also possible to use a cationic compound.

Here, the aggregating reaction of the aqueous ink may be achieved by reducing the dispersion stability of the particles (coloring material (for example, pigment), resin particles, etc.) which are dispersed in the aqueous ink, and causing the overall viscosity of the ink to rise. For example, the surface potential of the particles in the ink, such as pigment and resin particles, which are held in stable dispersion by a weakly acidic functional group, such as a carboxyl group, is lowered by reacting with an acidic material having a lower pKa, thereby reducing the dispersion stability. Hence, the acidic material forming a solidifying agent which is contained in the aqueous treatment liquid is desirably one having a low pKa, high solubility and valence of 2 or above, and more desirably, it is a bivalent or trivalent acidic material having a high buffering capacity in a lower pH region than the pKa of the functional group (for example, carboxyl group) that stabilizes the dispersion of the particles in the ink.

More specific examples are: phosphoric acid, oxalic acid, malonic acid, succinic acid, citric acid, phthalic acid, and the like. Furthermore, it is also possible to use other acidic materials that have similar pKa and solubility to these.

Of these acidic materials, citric acid has a high water retention capability, and tends to produce stronger physical strength of the aggregated ink, and therefore is desirable in situations where further mechanical strength is required. On the other hand, malonic acid, conversely, has a low water retention capability and is desirable in cases where it is wished to accelerate the drying of the treatment liquid.

In this way, the solidifying agent can also be selected appropriately on the basis of further secondary factors, apart from the function of solidifying the aqueous ink.

Possible examples of polyvalent metallic salts are salts of: alkali earth metals of group 2 of the periodic table (for example, magnesium or calcium), transition metals of group 3 of the periodic table (for example, lanthanum), cations from group 13 of the periodic table (for example, aluminum), lanthanides (for example, neodymium).

A desirable example of the cationic compound is a cationic surfactant. Desirably, the cationic surfactant is a primary, secondary or tertiary amine salt compound. Moreover, it is also possible to use an amphoteric surfactant which shows cationic properties in a desired pH range.

It is possible to use either one type or a combination of two or more types of solidifying agent.

The content ratio of the solidifying agent which solidifies the aqueous ink in the aqueous treatment liquid is desirably, 1 wt % to 4 wt %, more desirably, 5 wt % to 30 wt % and even more desirably 10 wt % to 25 wt %.

The aqueous treatment liquid used in the embodiment of the present invention can generally also include, in addition to the solidifying agent, a water-soluble organic solvent, and furthermore, similarly to the aqueous ink, may also contain other additives of various kinds.

Similarly to the aqueous ink, in respect of the water-soluble organic solvent, it is desirable to add water-soluble solvent having an SP value of 27.5 or lower, in order to suppress curl.

The organic solvent described above may be used independently, or a combination of two or more types of organic solvent may be used. Furthermore, desirably, these organic solvents are contained in a range of 1 wt % to 50 wt % in the treatment liquid.

The deposition amount of the solidifying agent is not subject to particular restrictions, provided that it is a sufficient amount to stabilize the aqueous ink, and desirably, the deposition amount is not less than 0.25 g/m$^2$, and from the viewpoint of making it easier to solidify the aqueous ink by aggregation, more desirably, it is not less than 0.30 g/m$^2$ and less than 2.0 g/m$^2$, and even more desirably, not less than 0.40 g/m$^2$ and less than 1.0 g/m$^2$.

Desirably, the surface tension (at 25° C.) of the aqueous treatment liquid is not lower than 20 mN/m and not higher than 60 mN/m. More desirably, it is not lower than 25 mN/m and not higher than 50 mN/m, and even more desirably, not lower than 25 mN/m and not higher than 45 mN/m. The surface tension is measured using an Automatic Surface Tensionometer CBVP-Z (made by Kyowa Interface Science) with the aqueous treatment liquid at 25° C.

Furthermore, from the viewpoint of achieving stable application in a range of 0.5 ml/m$^2$ to 3.5 ml/m$^2$, the viscosity of the aqueous treatment liquid at 25° C. is desirably not lower than 1.2 mPa·s and not higher than 15.0 mPa·s, more desirably, not lower than 2 mPa·s and not higher than 12 mPa·s, and even more desirably, not lower than 2 mPa·s and not higher than 8 mPa·s. In particular, when applying the aqueous treatment liquid to paper, the viscosity (at 25° C.) is desirably 2 mPa·s to 8 mPa·s and more desirably, 2 mPa·s to 6 mPa·s. The viscosity is measured using a Viscometer TV-22 (made by Told Sangyo) with the aqueous treatment liquid at 25° C.

Practical Examples

Embodiments of the present invention are described in more specific terms below with reference to practical examples, but the present invention is not limited to these examples.

Experimental Example 1

Tokubishi Art paper (basis weight 104 g/m$^2$) manufactured by Mitsubishi Paper Mills Ltd. was used as the recording medium.

An image was formed by ejecting droplets of ink at a resolution of 1200×1200 dpi onto a recording medium onto which treatment liquid had been applied and dried, while changing the in-plane average ejection volume of the ink deposited, in a stepwise fashion to 3, 4.5, 6 and 9 pl, and adjusting the droplet ejection rate so as to achieve the same droplet ejection volume (i.e. 6.7 g/m$^2$). Magenta was used as a first color and cyan was used as a second color, and the total ink droplet ejection volume was 13.4 g/m$^2$. The droplet size for each color in one printing action was set to 3, 4.5, 6 and 9 pl, uniformly. Thereupon, drying was carried out until the remaining amount of water became 4 g/m$^2$ and fixing was carried out using a heated roller (i.e., remaining amount of water: 4 g/m$^2$; total ejection volume: 13.4 g/m$^2$).

Experimental Example 2

The same method as the experimental example 1 was carried out, with the exception that the drying conditions were weakened and drying was performed until the remaining amount of water became 4.5 g/m$^2$ (i.e., remaining amount of water: 4.5 g/m$^2$; total ejection volume: 13.4 g/m$^2$).

Experimental Example 3

The same method as the experimental example 1 was carried out, with the exception that the droplet ejection rate of the second color was set in such a manner that the total droplet ejection volume of the ink became 14.5 g/m$^2$ (i.e., remaining amount of water: 4 g/m$^2$; total ejection volume: 14.5 g/m$^2$).

Experimental Example 4

The same method as the experimental example 2 was carried out, with the exception that the droplet ejection rate of the second color was set in such a manner that the total droplet ejection volume of the ink became 14.5 g/m$^2$ (i.e., remaining amount of water: 4.5 g/m$^2$; total ejection volume: 14.5 g/m$^2$).

Results

The offset characteristics of the recorded images were evaluated on the basis of the following criteria. The corresponding results are indicated in Table 2.

Excellent: No adherence of image to roller

Very Good: Some adherence of image to roller, but no image deterioration

Good: Status between "Very Good" above and "Average" below

Average: Some adherence of image to roller; localized white spots

Poor: Some adherence of image to roller, white spots observed in whole image

Very Poor: Significant adherence of image to roller, marked deterioration of image As indicated in FIG. 2, satisfactory results were obtained in images formed when the total of the in-plane average deposition volume M1 of the first color and the in-plane average deposition volume M2 of the second color was 10 pl or less and the absolute value of the difference between the in-plane average volume M1 of the first color and the average in-plane volume M2 of the second color was 3 pl or less.

Furthermore, in experimental example 2 which had an increased amount of remaining water after drying and experimental examples 3 and 4 which had an increased ink droplet ejection volume, quality was inferior to that of experimental example 1, but satisfactory results were obtained in images formed using a recording apparatus which satisfied Relationships (A) and (B).

Experimental Example 5

Under the same conditions as those in experimental examples 1 and 2, images were formed using two types of 3 μl and 6 μl as droplet volume sizes for the first color, while changing the in-plane average deposition volume of the first color by changing the ratio of the presence of the two types of droplet volume on the medium, and the image offset was evaluated. The in-plane average deposition volume of the second color was a uniform 6 pl. The corresponding conditions and results are shown in FIG. 3.

As indicated in FIG. 3, decline in quality was observed, as the total volume of the first color in-plane average volume M1 and the second color in-plane average volume M2 became greater. Furthermore, when the total volume exceeded 10 pl, then deterioration was observed in the image formed.

Experimental Example 6

Droplet ejection was carried out using a similar method to experimental example 1, using magenta as a first color, cyan as a second color and yellow as a third color, with the in-plane average deposition volume of the ink indicated in FIG. 4, so as to achieve a droplet ejection volume of the respective inks of 4.46 g/m$^2$ and a total droplet ejection volume of 13.4 g/m$^2$. Thereupon, drying was carried out until the remaining amount of water became 4 g/m$^2$. The corresponding results are indicated in FIG. 4 (i.e., remaining amount of water: 4 g/m$^2$; ejection volume of each color: 4.46 g/m$^2$; total ejection volume: 13.4 g/m$^2$ (=4.46 g/m$^2$×3 (colors)).

As indicated in FIG. 4, it was possible to obtain satisfactory results in the examples in which the relationship between the first color in-plane average volume M1, the second color in-plane average volume M2 and the tertiary in-plane average volume M3 satisfied Relationships (A) and (B). In examples where either one or both of Relationships (A) and (B) were not satisfied, the results were unsatisfactory and the evaluation was particularly bad in examples where the ink ejection volume was large.

Experimental Example 7

Droplet ejection was carried out using a similar method to experimental example 1, using magenta as a first color, black as a second color, cyan as a third color and yellow as a fourth color, with the in-plane average deposition volume of the ink indicated in FIG. 5, so as to achieve a droplet ejection volume of the respective inks of 3.35 g/m$^2$ and a total droplet ejection volume of 13.4 g/m$^2$. Thereupon, drying was carried out until the remaining amount of water became 4 g/m$^2$ (i.e., remaining amount of water: 4 g/m$^2$; ejection volume of each color: 3.35 g/m$^2$; total ejection volume: 13.4 g/m$^2$ (=3.35 g/m$^2$×4 (colors)). The corresponding results are indicated in FIG. 5.

As indicated in FIG. 5, it was possible to obtain satisfactory results in the examples in which the relationship between the first color in-plane average volume M1, the second color in-plane average volume M2, the tertiary in-plane average volume M3 and the fourth color in-plane average volume M4 satisfied Relationships (A) and (B). Results were unsatisfactory in the examples where Relationships (A) and (B) were not satisfied.

As indicated in experimental examples 6 and 7, it was possible to form a satisfactory image having little occurrence of offset, even in the case of three or four types of ink, by satisfying Relationships (A) and (B).

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

a treatment liquid deposition device which deposits on a recording medium a treatment liquid having a function to aggregate inks or increase viscosity of inks;

an ink deposition device which includes a plurality of ink heads for ejecting the inks of at least two types in such a manner that the inks are deposited on the recording medium on which the treatment liquid has been deposited;

an ink drying unit, which heats and dries the inks, and a fixing roller serving as a heating-pressuring device which directly contacts and fixes the inks that have been deposited on the recording medium, wherein the ink deposition device ejects the inks from the plurality of ink heads in such a manner that following Relationships (A) and (B) are satisfied where $M_x$ represents in-plane average deposition volume of one of the inks that is priorly deposited on the recording medium, $M_y$ represents in-plane average deposition volume of another one of the inks that is subsequently deposited on the recording medium, and N represents number of the types of the inks ($1 \leqq x < y \leqq N$), $M_x + M_y < 10$ picoliters; and Relationship (A)

$|M_x - M_y| = 3$ picoliters. Relationship (B)

2. The inkjet recording apparatus as defined in claim wherein the in-plane average deposition volume of the one of the inks that is priorly deposited on the recording medium is 4,8 picoliters or less.

3. The inkjet recording apparatus as defined in claim 1, wherein the in-plane average deposition volume of the another one of the inks that is subsequently deposited on the recording medium is 3 picoliters or less.

4. The inkjet recording apparatus as defined in claim 1, wherein the one of the inks that is priorly deposited on the recording medium has uniform in-plane deposition volume with respect to the recording medium.

5. The inkjet recording apparatus as defined in claim 1, wherein the one of the inks that is priorly deposited on the recording medium includes at least two types according to in-plane deposition volume, wherein one of the at least two types which has smallest in-plane deposition volume accounts for 60% or more of the one of the inks that is priorly deposited on the recording medium.

6. The inkjet recording apparatus as defined in claim 1, wherein the ink drying unit dries the inks in such a manner that a water content rate of the inks after the drying device dries the inks is 4 g/m$^2$ or less.

7. The inkjet recording apparatus as defined in claim 1, wherein total volume of the inks deposited on the recording medium is 13.5 g/m$^2$ or less.

8. The inkjet recording apparatus as defined in claim 1 employing a one-pass recording method as a printing method.

9. The inkjet recording apparatus as defined in claim 1, wherein recording medium is a coated paper.

10. An inkjet recording method comprising:

a treatment liquid deposition step of depositing on a recording medium a treatment liquid having a function to aggregate inks or increase viscosity of inks;

an ink deposition step of ejecting the inks of at least two types from a plurality of ink heads in such a manner that the inks are deposited on the recording medium on which the treatment liquid has been deposited;

a drying step of heating and drying the inks; and a fixing step of fixing the inks that have been deposited on the recording medium, by heating and pressurizing with a fixing roller that directly contacts the inks, wherein the inks are deposited on the recording medium in such a manner that following relationships (A) and (B) are satisfied where $M_x$ represents in-plane average deposition volume of one of the inks that is priorly deposited on the recording medium, $M_y$ represents in-plane average deposition volume of another one of the inks that is subsequently deposited on the recording medium, and N represents number of the types of the inks ($1 \leqq x < y \leqq N$), $M_x + M_y < 10$ picoliters; and Relationship (A)

$|M_x - M_y| = 3$ picoliters. Relationship (B)

11. The inkjet recording method as defined in claim 10, wherein the in-plane average deposition volume of the one of the inks that is priorly deposited on the recording medium is 4.8 picoliters or less.

12. The inkjet recording method as defined in claim 10, wherein the in-plane average deposition volume of the another one of the inks that is subsequently deposited on the recording medium is 3 picoliters or less.

13. The inkjet recording method as defined in claim 10, wherein the one of the inks that is priorly deposited on the recording medium has uniform in-plane deposition volume with respect to the recording medium.

14. The inkjet recording method as defined in claim 10, wherein the one of the inks that is priorly deposited on the recording medium includes at least two types according to in-plane deposition volume, wherein one of the at least two types which has smallest in-plane deposition volume accounts for 60% or more of the one of the inks that is priorly deposited on the recording medium.

15. The inkjet recording method as defined in claim 10, wherein the inks are dried in such a manner that a water content rate of the inks after the drying step is 4 g/m$^2$ or less.

16. The inkjet recording method as defined in claim 10, wherein total volume of the inks deposited on the recording medium is 13.5 g/m$^2$ or less.

17. The inkjet recording apparatus as defined in claim 1, wherein the fixing roller is constituted by a pair of rollers including one pressurizing and heating roller and one heating roller.

18. The inkjet recording apparatus as defined in claim 1, wherein the treatment liquid deposition device is an application roller.

19. The inkjet recording apparatus as defined in claim 1, further comprising a treatment liquid drying unit disposed between the treatment liquid deposition device and the ink deposition device.

* * * * *